US005802742A

United States Patent [19]

Baude et al.

[11] Patent Number: 5,802,742

[45] Date of Patent: Sep. 8, 1998

[54] INNER FOR SPORTS BOOT

[75] Inventors: Alain Baude, Izeron; Loïc David, Grand-Lemps, both of France

[73] Assignee: Societe d'Importation de Diffusion ou Distribution d'Articles de Sport (S.I.D.A.S.), Voiron, France

[21] Appl. No.: 793,850

[22] PCT Filed: Aug. 25, 1995

[86] PCT No.: PCT/FR95/01125

§ 371 Date: Apr. 9, 1997

§ 102(e) Date: Apr. 9, 1997

[87] PCT Pub. No.: WO96/07339

PCT Pub. Date: Mar. 14, 1996

[30] Foreign Application Priority Data

Sep. 8, 1994 [FR] France ..... 94 10939

[51] Int. Cl.[6] ..... A43B 5/04; A43B 23/07

[52] U.S. Cl. ..... 36/117.6; 36/10; 36/55

[58] Field of Search ..... 36/10, 117.6, 55

[56] References Cited

U.S. PATENT DOCUMENTS

| | | | |
|---|---|---|---|
| 3,786,580 | 1/1974 | Dalebout . | |
| 4,182,056 | 1/1980 | Dalebout . | |
| 4,433,494 | 2/1984 | Courvoisier et al. | 36/117.6 |
| 5,544,433 | 8/1996 | Borsoi et al. | 36/10 |
| 5,669,160 | 9/1997 | Pozzebon | 36/10 |

FOREIGN PATENT DOCUMENTS

| | | |
|---|---|---|
| A-2 541 095 | 8/1984 | France . |
| WO 94/09663 | 5/1994 | WIPO . |

*Primary Examiner*—Ted Kavanaugh
*Attorney, Agent, or Firm*—Oliff & Berridge, PLC

[57] ABSTRACT

A sports shoe inner comprises two pairs of separate flaps. A first pair is level with the wearer's instep. A second pair is located level with the wearer's lower leg. The flaps extend so as to overlap each other.

11 Claims, 2 Drawing Sheets

INNER FOR SPORTS BOOT

This application is a 371 of PCT/FR95/01125 filed on Aug. 25, 1995.

The present invention relates to an inner for a sports boot, in particular ski boot.

Some high boots, in particular sports boots and especially ski boots, contain an inner which is intended to protect the foot against friction with the rigid parts of the boot.

In a number of sports, it is actually necessary for the foot to be wedged securely in the boot, in order to allow accurate control of objects which are fixed to the latter, in particular a ski. The foot is therefore exposed to repeated friction, and the inner protects it accordingly.

However, the boot is only very approximately adapted to the specific morphology of the foot and the lower leg, because it must be suitable for a large number of users.

The same is true for the inner, which corresponds only very approximately to a standard foot shape.

The boot is adjusted to the user's foot using loops, straps or laces, the purpose of which is to tighten it to a greater or lesser extent, while comprising the boot around the foot.

This tightening has the drawback that it cannot be uniform and that it creates excess pressures at some sensitive points on the foot.

In order to alleviate these pressures, it is well known to provide a padded boot, comprising a tongue which covers the instep and the front part of the lower leg. This tongue makes it possible to close the opening which allows the foot to be inserted into the boot, to distribute the tightening force of the boot over the aforementioned regions of the foot and the lower leg, and to protect the sensitive parts of the foot.

However, a tongue of this type has the significant drawback that it shifts under the effect of the repeated movements of the foot relative to the boot, until it becomes displaced fully to one or other of the sides of the inner. It then no longer fulfills its function of protecting and holding the foot, so that the inner becomes particularly uncomfortable for the user.

It is also known, for example from the U.S. Patents U.S. Pat. No. 4,182,056 or U.S. Pat. No. 3,786,580, as well as from international application WO-94/09663, to provide an inner which does not comprise a tongue, but comprises flaps which overlap level with the instep and the front of the lower part of the leg.

Although they are generally satisfactory in practice, these inners have the drawback that they do not ensure perfect holding and comfort for the foot, in particular because they are not perfectly matched to the very particular asymmetric anatomy of this part of the body.

In addition, it is well known to shape an inner blank between the foot and the rigid shell of the boot, so as to obtain a distribution of the material of the inner in the space existing between the foot and the shell, by plastic flow or differential compression of this material. This shaping makes it possible to obtain an inner which fits and holds the foot.

The capacities of the material of the blank for plastic flow and differential compression remain, in spite of everything, relatively limited, and do not make it possible to obtain holding and comfort for the foot in all the regions of the latter. This is the case, in particular, when the blank employed has a rough shape, that is to say has the appearance of a large stocking which is open longitudinally level with those of its parts which correspond to the instep and the lower leg. A blank of this type does not correspond very precisely to the shape of the foot and the lower leg, and the limited capacities for plastic flow and compression of the material do not make it possible to compensate for this inaccuracy, in order to obtain the desired holding and comfort.

The present invention aims to overcome these various drawbacks.

Its object is to provide an inner which, remaining standard, is more padded at some points than at others so as to correspond optimally to the anatomical shape of the foot.

The inner to which it relates is of the type comprising a part intended to hold the foot, and a substantially tubular part intended to surround the lower leg, and comprising flaps which overlap level with the instep and the lower part of the leg.

According to the invention, the inner comprises two pairs of independent flaps, namely

- a first pair, which is located level with the instep, which comprises a first flap, extending from the inner side of the foot, and a second flap, extending from the outer side of the foot, this first flap overlapping this second flap above the outer face of the user's instep, and
- a second pair, which is located level with the lower leg, which comprises a first flap, extending from the outer side of the foot, and a second flap, extending from the inner side of the foot, this first flap overlapping this second flap above the inner face of the lower leg.

This inner makes it possible to obtain perfect holding and comfort of the foot in the boot.

Specifically, the foot and the lower leg have an anatomical asymmetry in their shapes and in their volumes. The top of the instep is positioned on the inner side of the foot, so that its lateral inner face is relatively steep, while its outer face descends with a gentler slope. For their part, the ankle and the lower leg have a hollow above the inner malleolus, and therefore substantially level with the inner face of the lower leg, which does not exist on the outer side.

In the inner according to the invention, the flaps of said "first pair", which are located level with the instep, overlap essentially above the outer face of the instep and create a double padding thickness at this point on the foot. The flaps of said "second pair", which are located level with the lower leg, overlap above the inner face of the lower leg, and create a double padding thickness at this point on the leg.

These double thicknesses make it possible to fill the spaces which exist between the foot and the boot because of the aforementioned hollow anatomical parts existing level with the outer face of the instep and the inner face of the lower leg. They allow the foot to be held perfectly in the boot, by distributing the bearing force of this boot against the inner level with these hollows.

Thus, according to the invention, the flaps are asymmetric, that is to say of different length within each pair, and overlap in a manner which is reversed from one pair to another, on the outside of the instep as regards said "first" pair, and on the inside of the lower leg as regards said "second" pair.

The inner according to the invention may be made of a traditional padded material, that is to say one which cannot be fitted very precisely to the specific anatomy of the user's foot. Advantageously, however, the inner is made of a material which can be shaped between the foot and the boot, so that its shape can be adapted to the specific anatomy of the user's foot, in such a way that perfect comfort is obtained. In this second case, the inner is either made of thermoplastic, made malleable by heating in order for it to be thermoformed, or consists of a flexible casing with double walls which define a closed cavity between them, into which a polymerizable material is injected under pressure, or self-moldable, that is to say containing a product which can undergo plastic flow when it is compressed, thus rendering uniform the pressure of the foot against the wall of the inner.

Before this shaping, the inner according to the invention has a shape which corresponds relatively precisely to the general shape of the foot and the lower leg, so that the flaps can be positioned suitably and precisely with respect to the foot and the lower leg when this shaping is carried out. It is therefore indeed an "inner" and not a rough blank, as mentioned above, intended to take on the shape of the foot and the lower leg only during this shaping. This inner is preferably made by assembling at least two material pieces, namely a piece constituting the sole, and at least one other piece constituting the rest of the inner, that is to say the upper, intended to surround the foot, and the sock intended to surround the lower leg.

Advantageously, in said first pair of flaps, which is located level with the instep, the flap intended to be overlapped is designed so that it does not extend beyond the top of the instep but borders this top, set back therefrom. Thus, this flap does not create an overthickness level with this top, which is advantageous in the case of an inner made of traditional material, as mentioned above, but essential in the case of an inner made of shapeable material. If necessary, the extreme edge of this flap has a notch intended to keep it set back from this top.

In said second pair of flaps which is located level with the lower leg, the flap intended to be overlapped may be designed so that it does not extend beyond the median plane of the leg. However, this flap preferably extends slightly beyond this median plane, by of the order of a few centimeters, so as to constitute a double padding thickness which protects the front of the leg level with the tibial crest.

To explain clearly, the invention is again described below, with reference to the appended schematic drawing which, by way of example, represents a preferred embodiment of the inner to which it relates.

FIG. 1 represents three pieces 2, 3, 4 of flexible thermoformable synthetic material, which are intended to be assembled by stitching in order to form the ski boot inner 5 represented in FIG. 2.

The piece 2 corresponds to the general shape of the lower face of a right foot.

The piece 3 is intended to constitute the upper of the inner 5. Its lower edge 3*a* is intended to be stitched onto the perimeter of the piece 2. Its ends 3*b*, having rounded outer edges 3*c*, are intended to be stitched to one another via these edges 3*c*, as far as points of inflexion 3*d*, in order to constitute the front of the inner 5. Beyond the points of inflexion 3*d*, the piece 3 comprises two projecting lateral parts of rounded shape, of which the one 3*e* located toward the bottom of FIG. 1 is longer than the one 3*f* located toward the top.

Figure 1:
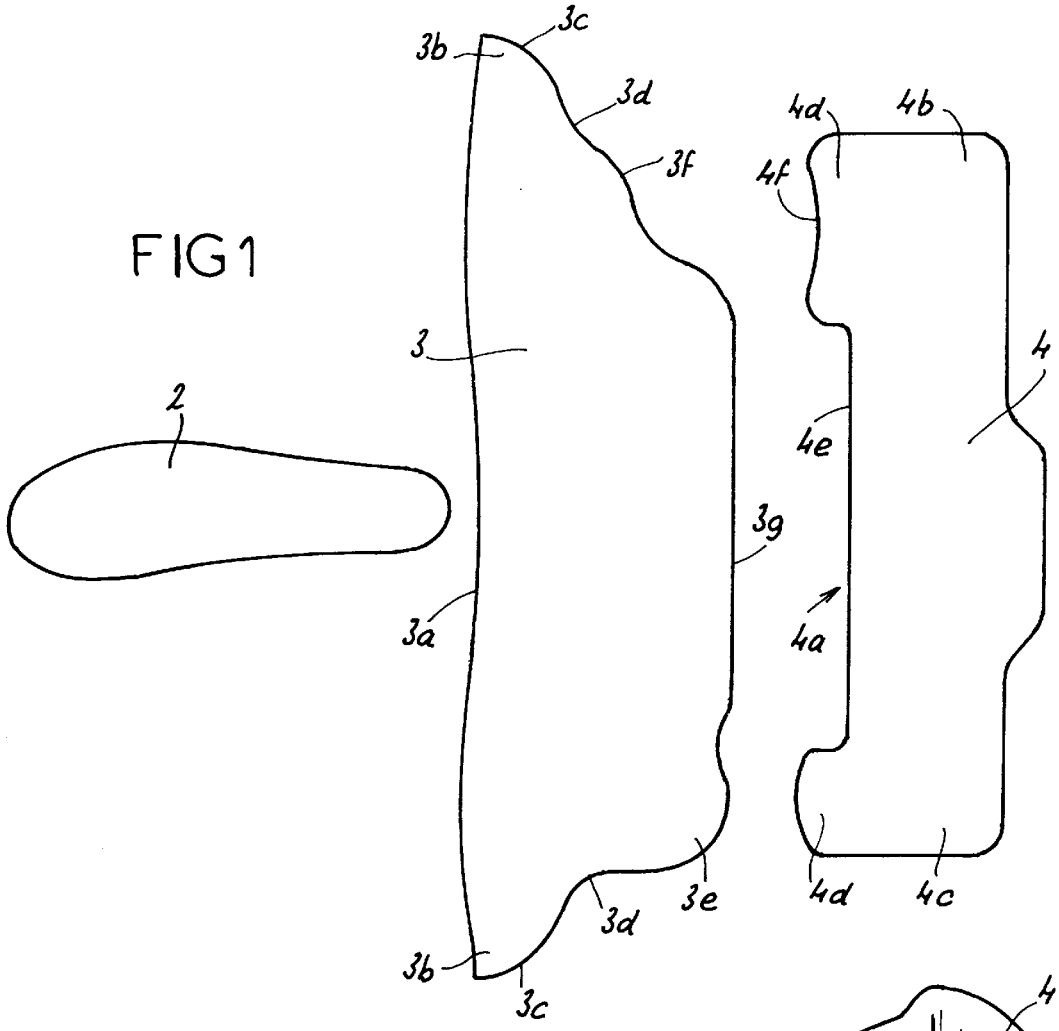
FIG. 1 is a flat view of three material pieces making it possible to construct this inner, for a right foot.

The piece 4 has a lower notch 4*a* which delimits, on the one hand, an edge 4*e* via which this piece 4 is intended to be stitched to the upper edge 3*g* of the piece 3 and, on the other hand, two lateral parts 4*b*, 4*c* which have lower extensions 4*d*, of which the one located toward the top in FIG. 1 has a curved extreme edge 4*f*. The lateral part 4*b*, located toward the top of FIG. 1, is longer than the part 4*c* located toward the bottom.

Figure 2:
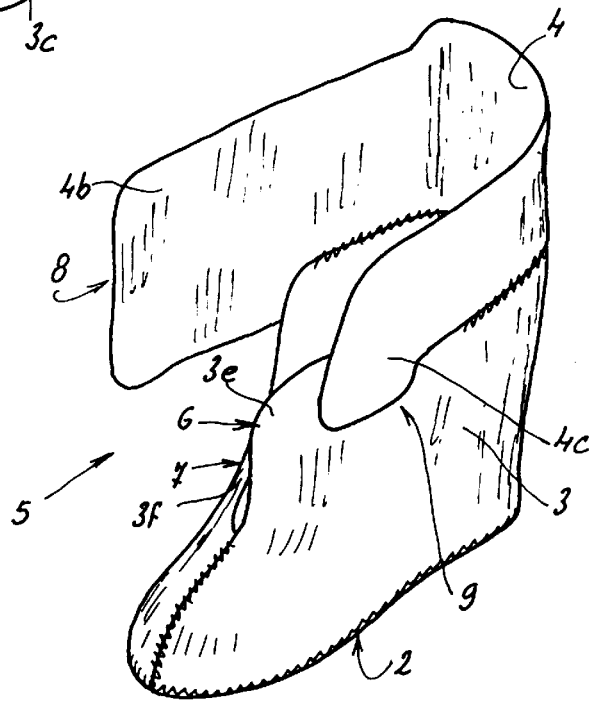
FIG. 2 is a perspective view of this inner, before final shaping.

FIG. 2 represents the inner as obtained by assembling these pieces 2, 3, 4.

By virtue of the specific shape of these pieces the inner 5 corresponds relatively precisely to the general shape of a foot and the lower leg.

With reference to FIGS. 1 and 2, it is apparent that the pieces 2 to 4 constitute respectively the sole of this inner 5, its upper, intended to hold the user's foot, and a substantially tubular top part, intended to surround the lower leg.

It is also apparent that the lateral parts 3*e* and 3*f*, on the one hand, and that the lateral parts 4*b* and 4*c*, on the other hand, constitute two independent pairs of flaps 6, 7, 8, 9 which overlap level with the instep, on the one hand, and level with the lower part of the leg, on the other hand.

Figure 3:
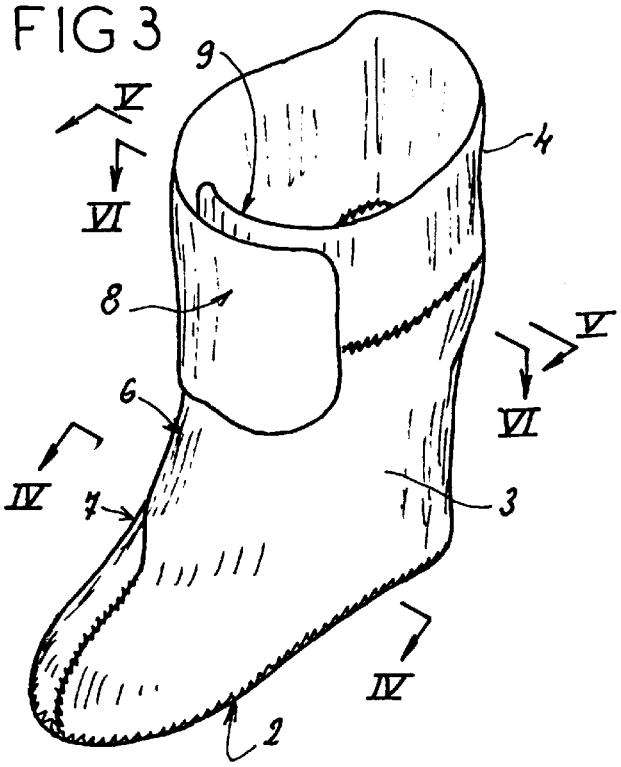
FIG. 3 is a view, similar to FIG. 2, of this inner after final shaping.
Figure 4:
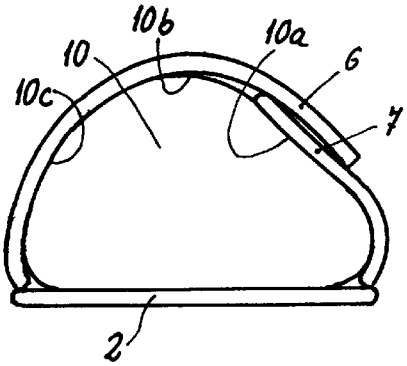
FIGS. 4 to 6 are sectional views of this inner after shaping, into which the foot of the user has been inserted, respectively along the lines IV—IV, V—V and VI—VI in FIG. 3.

As shown by FIGS. 2, 3 and 4, the part 3*e* constitutes a first flap 6, extending from the inside of the foot, which can overlap, above the outer face of the instep, with a second flap 7 constituted by the part 3*f*. The flap 6 therefore extends above the outer face 10*a* of the instep 10 while the flap 7 is designed so that it does not extend beyond the top 10*b* of the instep but borders this top, set back therefrom.

As shown by FIGS. 2, 3, 5 and 6, the part 4*b* constitutes a first flap 8, extending from the outside of the foot, which can overlap, above the inner face of the lower leg, with a second flap 9 constituted by the part 4*c*. The flap 8 therefore extends above the inner face 11*a* of the lower leg 11, while the flap 9 extends slightly beyond the median plane of the leg 11, over a length of the order of a few centimeters.

The inner 5 as represented in FIG. 2 is intended to be heated so that its constituent thermoplastic is rendered malleable, then to be placed in a rigid ski boot shell and to receive the user's foot. The flaps 6 to 9 are positioned in such a way as to overlap, and in such a way that the inner 5 tightly encloses the user's foot. The curved edge 4*f* allows the lower part of the flap 8 to match the curvature of the instep 10.

After the boot has been tightened, the inner 5 is shaped between the user's foot and the shell of the boot, so as to be adapted to the specific anatomy of the user's foot.

FIG. 3 represents the inner 5 after this final shaping has been carried out.

This inner 5 makes it possible to obtain perfect holding and comfort for the foot in the boot.

Specifically, the foot and the lower leg have an anatomical asymmetry in their shapes and in their volumes.

As shown by FIG. 4, the top 10*b* of the instep 10 is positioned on the inner side of the foot, so that its inner lateral face 10*c* is relatively steep, while its outer face 10*c* descends with a gentler slope.

Figure 5:
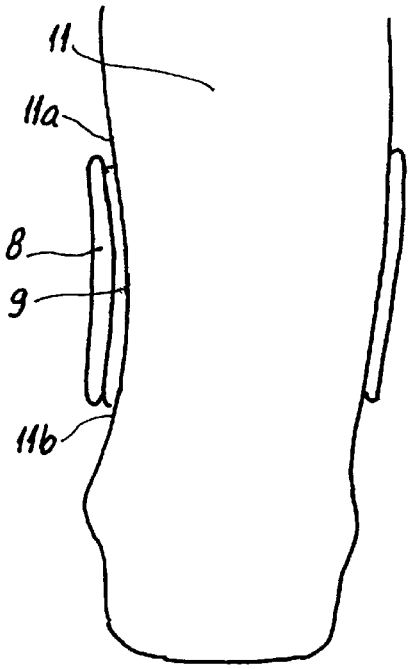

As shown by FIG. 5, the ankle and the lower leg 11 have a longitudinal hollow 11*b* above the inner malleolus, and therefore substantially level with the inner face 11*a* of the lower leg 11, which does not exist on the outer side.

In the inner 5, the flaps 6, 7 create a double padding thickness level with the outer face 10*a* of the instep. The flaps 8, 9 create a double padding thickness level with the Inner face of the lower leg, or rather on the front thereof. These double thicknesses make it possible to fill the spaces existing between the foot and the boot, level with the outer face 10*a* of the instep 10 and the front of the inner face 11*a* of the lower leg. They thus allow the foot to be held perfectly, by distributing the bearing force of the latter against the inner level with these hollows.

Thus, in the inner 5, the flaps 6 to 9 are asymmetric, which is to say of different length within each pair of flaps, and overlap in a way which is reversed from one pair to the other, on the outside of the instep 10 as regards the pair of flaps 6, 7, and on the inside of the lower leg as regards the pair of flaps 8, 9.

Figure 6:
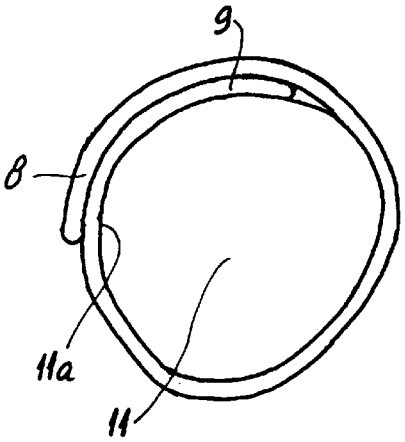

By virtue of its relatively short length, the flap 7 does not extend beyond the top 10*b* of the instep 10, but borders this top, set back therefrom. Thus, this flap 7 does not create an uncomfortable overthickness level with this top. For its part, because it extends slightly beyond the median plane of the leg, the flap 9 constitutes a double padding thickness, making it possible to protect the front of the leg level with the tibial crest, as shown by FIG. 6.

The lower extensions 4*d* of the piece 4 overlap the upper edge of the flaps 6 and 7, in order to fill the space which may exist at this point between the crossed edges of the various flaps, so as to make the inner air-tight.

The flaps 8 and 9 can be kept fixed relative to one another, when the inner 5 is being worn, using complementary self-gripping bands fixed to each of them. In addition, the inner 5 may comprise reinforcements between the pieces 3 and 4, extending above the seam which joins these two pieces to each other.

We claim:

1. An inner for a sports boot, comprising a part intended to hold a wearer's foot, a substantially tubular part intended to surround a wearer's lower leg, and two pairs of independent flaps, wherein a first pair of said two pairs is located level with a wearer's instep and includes a first flap extending from an inner side of the wearer's foot, and a second flap extending from an outer side of the wearer's foot, said first flap overlapping said second flap above an outer face of the wearer's instep, and a second pair of said two pairs is located level with the wearer's lower leg and includes a third flap extending from the outer side of the wearer's foot, and a fourth flap extending from the inner side of the wearer's foot, said third flap overlapping said fourth flap above an inner face of the wearer's lower leg.

2. An inner according to claim 1, made of a padded material that is not precisely fitted to a specific anatomy of the wearer's foot.

3. An inner according to claim 1, made of a material that is shapeable between the wearer's foot and the boot.

4. An inner according to claim 3, made of thermoplastic, made malleable by heating in order to be thermoformed.

5. An inner according to claim 1, having a shape that corresponds relatively precisely to a general shape of the wearer's foot and the wearer's lower leg.

6. An inner according claim 5, made by assembling at least two material pieces, namely a piece (2) constituting a sole, and at least one other piece constituting a remainder of the inner intended to surround the wearer's foot and lower leg.

7. An inner according to claim 1, wherein the second flap does not extend beyond a top of the wearer's instep but borders the top, set back therefrom.

8. An inner according to claim 7, wherein an extreme edge of the flap (7) has a notch intended to keep it set back from the top of the instep.

9. An inner according to claim 1, wherein said fourth flap does not extend beyond a median plane of a wearer's leg.

10. An inner according to claim 1, wherein said fourth flap extends slightly beyond a median plane of a wearer's leg, by a few centimeters, so as to constitute a double padding thickness which protects a front of the wearer's leg level with a tibial crest.

11. An inner according to claim 1, wherein said third and fourth flaps include lower extensions that overlap an upper edge of said first and second flaps, one of said lower extensions having a curved extreme edge.

* * * * *